United States Patent [19]

North et al.

[11] Patent Number: 4,515,523

[45] Date of Patent: May 7, 1985

[54] COOLING ARRANGEMENT FOR AIRFOIL STATOR VANE TRAILING EDGE

[75] Inventors: William E. North, Concord Township, Delaware County; Paul C. Holden, Newtown; Kent G. Hultgren, Swarthmore, all of Pa.

[73] Assignee: Westinghouse Electric Corp., Pittsburgh, Pa.

[21] Appl. No.: 547,292

[22] Filed: Oct. 28, 1983

[51] Int. Cl.[3] ..... F01D 5/14

[52] U.S. Cl. ..... 415/115; 416/97 R

[58] Field of Search ..... 415/115; 416/97 R, 96 R

[56] References Cited

U.S. PATENT DOCUMENTS

| | | | |
|---|---|---|---|
| 3,628,880 | 12/1971 | Smuland et al. | 415/115 |
| 3,628,885 | 12/1971 | Sidenatick et al. | 416/97 |
| 3,809,494 | 5/1974 | Redman | 416/97 |
| 3,819,295 | 6/1974 | Hauser et al. | 416/97 |
| 3,825,984 | 7/1974 | Linko et al. | 416/97 X |
| 3,844,678 | 10/1974 | Sterman et al. | 416/97 |
| 3,866,448 | 2/1975 | Dennis et al. | 72/30 |
| 3,921,271 | 11/1975 | Dennis et al. | 416/97 X |
| 4,021,139 | 5/1977 | Franklin | 416/97 R |
| 4,407,632 | 10/1983 | Liang | 415/115 X |
| 4,474,532 | 10/1984 | Pazder | 416/97 R |

FOREIGN PATENT DOCUMENTS

| | | | |
|---|---|---|---|
| 0034961 | 9/1981 | France | 416/97 R |

*Primary Examiner*—Robert E. Garrett
*Assistant Examiner*—Timothy E. Nauman
*Attorney, Agent, or Firm*—E. C. Arenz

[57] ABSTRACT

A hollow, airfoil shaped stator vane 10 is provided in its trailing edge portion with staggered rows of pin fins 20, 22 and 24 and with longitudinal ribs 26 which provide the required stiffness for the thin wall design of the vane, the ribs being provided with protuberances 36 in those locations where the turbulence inducing pin fins are displaced by the presence of the ribs.

3 Claims, 3 Drawing Figures

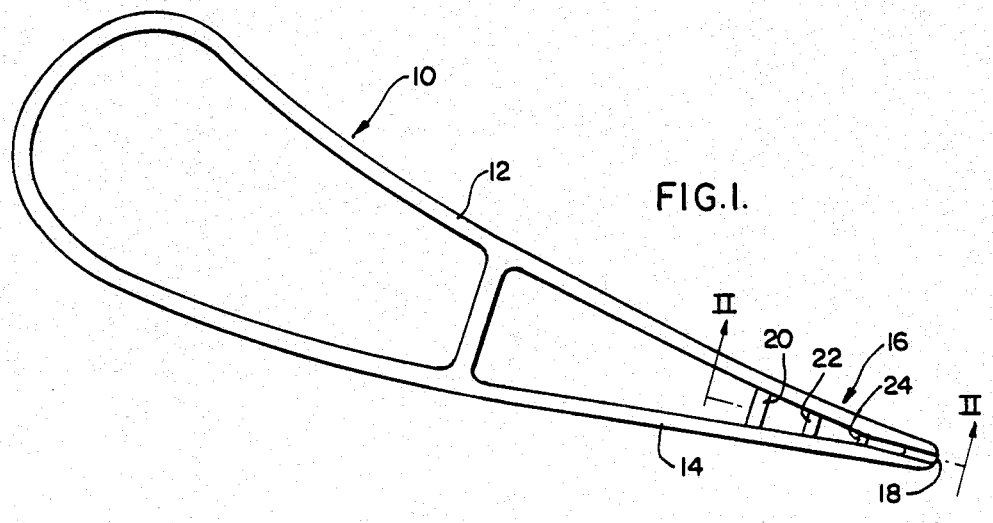
FIG.1.
FIG.2.
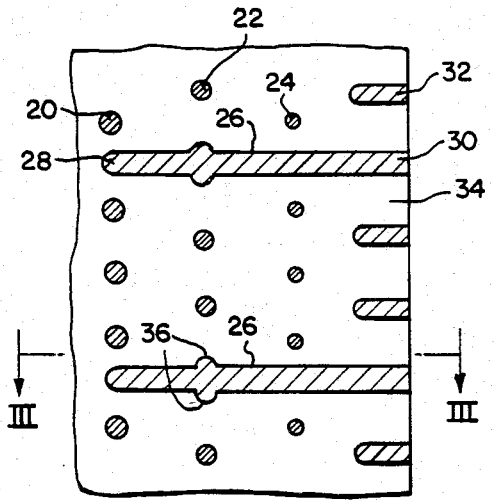
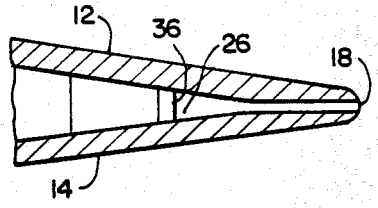
FIG.3.

COOLING ARRANGEMENT FOR AIRFOIL STATOR VANE TRAILING EDGE

BACKGROUND OF THE INVENTION

This invention pertains to the art of gas turbine stator vanes, and in particular to an arrangement to obtain adequate cooling with sufficient structural integrity of the trailing edge part of a thin wall stator vane design.

With maximum operating temperatures of gas turbines increasing with advances in the art, higher cooling requirements for the turbine airfoils have been imposed. This has led to what are called thin wall designs of the stator vanes for example, with cooling being enhanced by internal pin fins which are intended to create turbulence and swirling to promote heat transfer. One of the areas in which adequate cooling is relatively important is in the trailing edge region of the vane which includes the exit slots or openings at the extreme trailing edge, and in which, with a thin wall design, the metal forming the critical throat region for the exit becomes progressively thinner. It is important to avoid any significant deformation of the metal in the trailing edge portion since it defines, with adjacent vanes, the critical throat region of the nozzle. While the internal pin fins which interconnect the two opposite walls of the vane in this region serve to a degree to strengthen the airfoil in this area, they are subject to breaking and the structural integrity of this area of the blade can be increased by adding longitudinal struts or ribs, for example as shown in U.S. Pat. No. 3,809,494. However, these struts tend to defeat to some degree the purpose of the staggered rows of pin fins in certain areas since they tend to smooth the flow as is stated in the noted patent.

The aim of this invention is to provide an arrangement of pin fins and longitudinal ribs of a character that structural integrity of the blade is insured in this area while obtaining adequate turbulence of the air to obtain the required heat transfer effectiveness.

SUMMARY OF THE INVENTION

In accordance with the invention, a turbine stator vane of thin wall design having the internal pin fins in staggered rows extending between the opposite walls of the vane in the area closely upstream from the spanwise openings formed in the trailing edge of the vane is provided with the improvement comprising a series of first longitudinal ribs extending in intersecting relation to the staggered rows of pin fins, with the ribs including means thereon for inducing turbulent air flow at locations therealong corresponding to the locations of pin fins displaced by the presence of the ribs.

In the currently preferred form of the invention the extreme trailing edges of the longitudinal ribs are located to define in part the spanwise openings at the extreme trailing edge with relatively shorter ribs, and the longitudinal ribs are also of an extent that their upstream ends are generally aligned with the first row of pin fins.

BRIEF DESCRIPTION OF THE DRAWINGS

FIG. 1 is an end view of the shell of a stator vane having the trailing edge portion arrangement according to the invention;

FIG. 2 is a fragmentary section corresponding to one taken along the line II—II of FIG. 1; and FIG 3 is a fragmentary section corresponding to one taken along the line III—III of FIG. 2.

DESCRIPTION OF THE PREFERRED EMBODIMENT

In FIG. 1, a typical end view of a stator vane shell for a gas turbine, such as the first stage thereof, is shown with the inserts for the vane omitted since it is only the trailing edge portion of the vane to which this invention is directed. The shell 10 is of typical airfoil shape including opposite side walls 12 and 14 which converge toward the trailing edge portion generally designated 16 with the metal of the walls becoming progressively thinner in the area which defines the outlet 18 at the extreme trailing edge.

Referring to FIG. 2 as well, three rows 20, 22, and 24, of pin fins are provided with the pin fins in each row being staggered with respect to the pin fins in each adjacent row. Preferably the pin fins are of progressively decreasing diameter in the direction of airflow. The pin fins derive their heat transfer effectiveness from the turbulence of the wakes spreading downstream from the pins. While the pin fins are integrally cast with the shell so that they are integral with the opposing walls, it is our view that there is a possibility of inadequate structural integrity provided by the pin fins alone. Therefore, in accordance with our invention longitudinal ribs 26 are provided to enhance the structural integrity of the trailing edge portion of the vane. As shown in FIG. 2, for example, these ribs are provided at selected intervals and intersect the rows of pin fins. In the currently preferred form, the upstream ends 28 of the ribs are in generally aligned relation with the upstream row 20 of pin fins. The ribs 26 extend downstream to the extreme trailing edge where their downstream ends 30 function with adjacent short ribs 32 to define relatively uniformly spaced spanwise openings 34 which function as flow control exit air slots.

While the problem of deformation is solved by the ribs providing the stiffness needed for geometrical control of the airfoil, the provision of ribs having smooth surfaces would tend to defeat the purpose of the pin fins because of the fact that some of the turbulence-generating pins are displaced by the ribs. In the illustration, every third pin in the intermediate row of pin fins 22 must be omitted because of the presence of the ribs 26. Therefore, in accordance with the invention, the ribs 26 are not smooth surfaced, but rather are provided with means to induce turbulence at any location where the pins are displaced. These means, as illustrated in FIG. 2, being oppositely projecting protuberances 36 at those locations where the pins have been displaced.

We claim:

1. In a turbine airfoil-shaped stator vane of thin wall design having internal pin fins in staggered rows extending between the opposite walls of the vane in the area closely upstream from spanwise openings formed in the trailing edge of the vane, the improvement comprising:

a series of first ribs having a height to extend completely between and to connect said opposite walls of said vane to each other and extending longitudinally in a flowwise direction in intersecting relation to said staggered rows of pin fins but out of intersecting relation with any individual ones of said pin fins, said ribs including spanwise protruding means thereon for inducing turbulent air flow at locations therealong corresponding to the locations of pin fins displaced by the presence of said ribs.

2. In a vane according to claim 1 wherein:

said spanwise openings are relatively uniformly spaced and are formed in part between relatively short ribs downstream from said pin fins, and said first ribs are located in an array in which said first ribs coincide in location in a radial direction with some of said short ribs so that the downstream end portions of said first ribs function with adjacent short ribs to define said uniformly spaced spanwise openings.

3. In a vane according to claim 1 wherein:

the upstream ends of said first ribs are generally aligned with the upstream row of said pin fins.

* * * * *